US006412706B1

(12) United States Patent
Guerrassi et al.

(10) Patent No.: US 6,412,706 B1
(45) Date of Patent: Jul. 2, 2002

(54) FUEL INJECTOR

(75) Inventors: Noureddine Guerrassi, Vineuil; Christophe Tapin, La Chaussee Saint-Victor; Bernard Babiarz, La Rochelle, all of (FR)

(73) Assignee: Lucas Industries, Paris (FR)

( * ) Notice: Subject to any disclaimer, the term of this patent is extended or adjusted under 35 U.S.C. 154(b) by 0 days.

(21) Appl. No.: 09/262,969

(22) Filed: Mar. 4, 1999

(30) Foreign Application Priority Data

Mar. 20, 1998 (GB) ..... 9805854

(51) Int. Cl.[7] ..... F02M 41/16

(52) U.S. Cl. ..... 239/96; 239/533.3; 239/533.8; 239/533.9

(58) Field of Search ..... 239/533.3, 533.4, 239/533.5, 533.8, 533.9, 533.11, 88, 96, 95, 89, 90, 91, 92, 124

(56) References Cited

U.S. PATENT DOCUMENTS

| | | | | | |
|---|---|---|---|---|---|
| 1,701,089 | A | * | 2/1929 | Salis | 239/96 |
| 1,850,250 | A | * | 3/1932 | Salis | 239/96 |
| 2,556,369 | A | * | 6/1951 | Hogeman | 239/96 |
| 3,610,529 | A | | 10/1971 | Huber | |
| 3,990,157 | A | * | 11/1976 | Valentine | 35/13 |
| 4,440,133 | A | | 4/1984 | Jourde | |
| 4,482,093 | A | * | 11/1984 | Hafner et al. | 239/533.3 |
| 4,603,671 | A | | 8/1986 | Yoshinaga et al. | |
| 4,946,106 | A | * | 8/1990 | Turchi et al. | 239/96 |
| 5,441,029 | A | * | 8/1995 | Hlousek | 239/96 |
| 5,671,715 | A | * | 9/1997 | Tsuzuki | 239/96 |
| 5,673,669 | A | * | 10/1997 | Maley et al. | 239/96 |
| 5,860,597 | A | * | 1/1999 | Tarr | 239/533.3 |

FOREIGN PATENT DOCUMENTS

| | | |
|---|---|---|
| DE | 196 34 105 A1 | 8/1996 |
| DE | 297 08 369 U1 | 5/1997 |
| EP | 0 615 064 A1 | 2/1994 |
| EP | 0 778 411 A2 | 6/1997 |
| GB | 2316447 | 2/1998 |

OTHER PUBLICATIONS

European Search Report and Annex, Application No. EP 99 30 1458, Jul. 8, 1999.
United Kingdom Search Report, Application No. GB 9717464.3, Nov. 13, 1997.

* cited by examiner

*Primary Examiner*—Lesley D. Morris
*Assistant Examiner*—Christopher S. Kim
(74) *Attorney, Agent, or Firm*—Wells St John, P.S.

(57) ABSTRACT

A fuel injector comprising a valve needle, engagable with the seating to control fuel flow through a fuel outlet, the valve needle having a thrust surface oriented such that the application of fuel under pressure thereto applies a force to the valve needle urging the valve needle away from the seating. The fuel injector also comprises a valve member for controlling fuel pressure within a control chamber and a piston member slidable within a bore and defining, with the bore, the control chamber. The piston member is exposed to fuel pressure within the control chamber and is arranged to transmit a force applied by the fuel pressure to the valve needle. The piston member has an effective surface area exposed to the fuel pressure which is greater than that of the thrust surface so as to urge the valve needle towards the seating.

23 Claims, 2 Drawing Sheets

FUEL INJECTOR

This invention relates to a fuel injector for use in delivery of fuel under pressure to a cylinder of an associated compression ignition internal combustion engine. In particular, the invention relates to a fuel injector of the type suitable for use in a fuel supply system of the common rail type, the injector being actuable to permit fuel to be delivered to the cylinder of the associated engine from the common rail, the common rail being charged with fuel under pressure by an appropriate high pressure fuel pump. A plurality of similar injectors are arranged to receive fuel from the common rail.

It is known to control the operation of such a fuel injector by using a valve to control the fuel pressure within a control chamber, the fuel pressure within the control chamber acting upon a surface associated with the needle of the injector to apply a force to the needle urging the needle towards its seating. In order to ensure that injection terminates quickly upon closing the valve, it is known to use a flow restrictor to limit the fuel pressure acting on the needle and urging the needle away from its seating.

According to the invention there is provided a fuel injector for use in a common rail fuel system, the injector comprising a valve needle spring biased towards a seating, the valve needle including at least one thrust surface orientated such that the application of fuel under pressure thereto applies a force to the needle urging the needle from its seating, a piston slidable within a bore and defining, with the bore, a control chamber, the fuel pressure within the control chamber being controlled by a control valve, the fuel pressure within the control chamber applying a force to the piston which is transmitted to the valve needle urging the needle towards its seating, wherein the effective area of the piston is greater than the effective area of the thrust surface (s) of the needle.

Such an arrangement is advantageous in that the use of flow restrictors restricting the rate of fuel flow towards the seating can be avoided, the difference in area producing the biasing force necessary to cause rapid termination of injection.

The force is conveniently transmitted from the piston to the injector needle through a thrust pin of short axial length. Reducing the length of the thrust pin is advantageous as flexing of the thrust pin, in use, is reduced. Where a relatively long thrust pin is used, the flexing of the thrust pin results in jerky movement of the injector needle and hence in poor injection quality.

Figure 1:
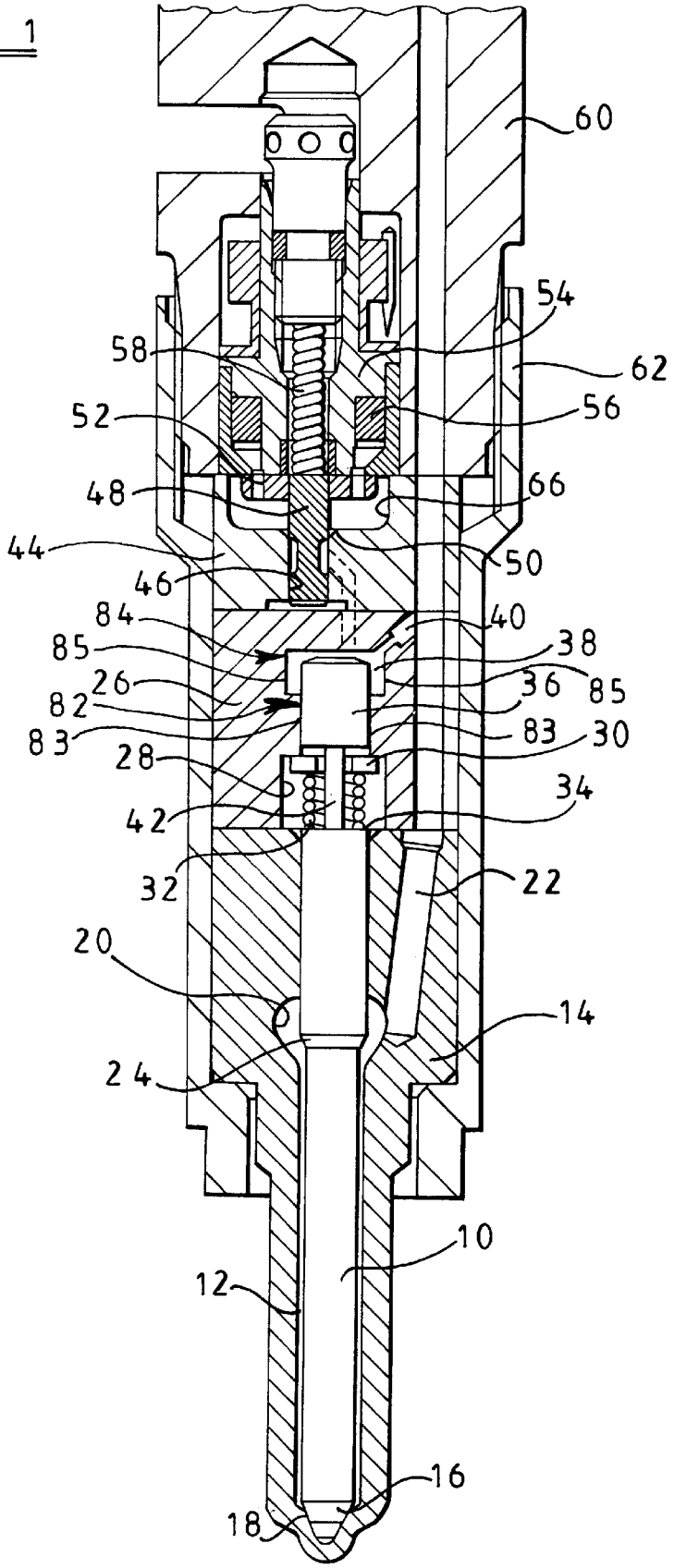
Figure 2:
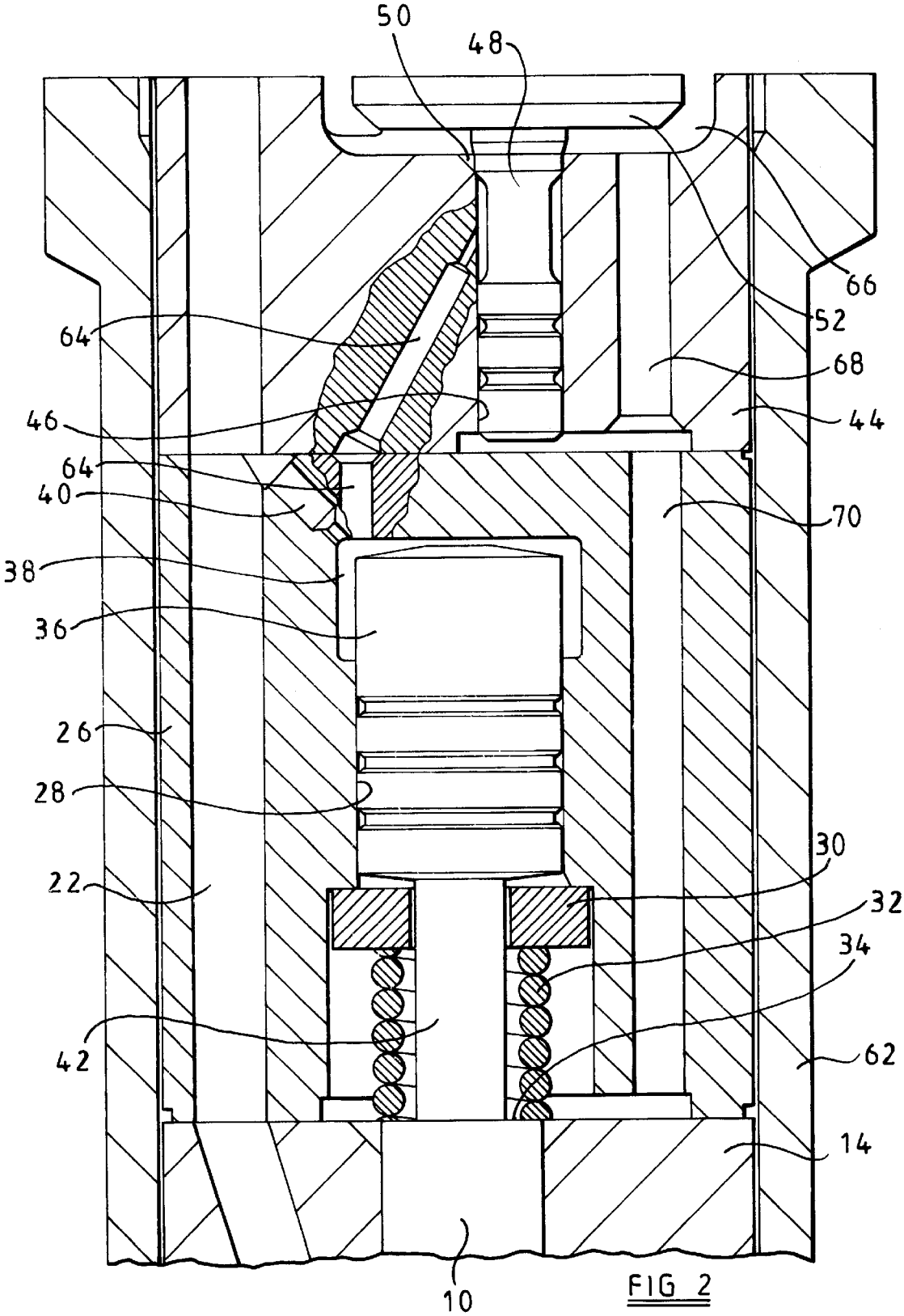

The invention will further be described, by way of example, with reference to the accompanying drawings, in which:

FIG. 1 is a sectional view of part of an injector in accordance with an embodiment; and FIG. 2 is an enlarged view of part of the injector of FIG. 1.

The injector illustrated in the accompanying drawings comprises a valve needle 10 which is slidable within a blind bore 12 formed in a nozzle body 14. The valve needle 10 includes, at its lower end, a frusto-conical surface 16 which is arranged to engage a frusto-conical seating 18 formed adjacent the blind end of the bore 12, engagement of the valve needle 10 with the seating 18 controlling the supply of fuel from the bore 12 to one or more outlet openings (not shown) which communicate with the bore 12 downstream of the seating 18.

The bore 12 is shaped to define an annular gallery 20 which communicates with an inlet passage 22 whereby fuel is supplied from a source of fuel under high pressure, for example a common rail charged with fuel under high pressure by a suitable high pressure fuel pump. As illustrated in FIG. 1, the part of the needle 10 located within the chamber defined by the annular gallery 20 is of stepped form and defines a thrust surface 24 which is angled such that the application of fuel under high pressure thereto applies a force to the valve needle urging the valve needle 10 in an upward direction away from the seating 18. Similarly, the application of fuel under high pressure to the frusto-conical end region 16 of the needle 10 applies a force to the needle 10 urging the needle 10 away from its seating 18.

The upper end of the nozzle body 14 abuts a spring housing 26 which is shaped to define a blind bore 28 of stepped form which extends coaxially with the bore 12 of the nozzle body 14. A lower end of the bore 28 defines a spring chamber within which a spring abutment member 30 is located, the spring abutment member 30 engaging a step forming part of the bore 28. A helical compression spring 32 is engaged between the spring abutment member 30 and an upper surface 34 of the valve needle 10, the spring 32 acting to bias the valve needle 10 towards the seating 18.

Above the step with which the spring abutment member 30 is in engagement, a piston 36 is located, the piston 36 being in sliding engagement with the adjacent part of the bore 28, the piston 36 and upper end of the bore 28 together defining a control chamber 38 which communicates, through a restricted passage 40 with the supply passage 22. A thrust pin 42 of relatively short axial length is engaged between the lower surface of the piston 36 and the upper surface 34 of the valve needle 10. The step of bore 28 defines a first bore portion 82 having a surface 83. Bore 28 also includes a second bore portion 84 having a surface 85.

The upper surface of the spring housing 26 abuts the lower surface of a valve housing 44 which is provided with a through bore 46 within which a control valve member 48 is slidable. The control valve member 48 includes an upper end region of enlarged diameter which is engagable with a seating 50 defined around an upper end of the through bore 46. The upper end of the valve member 48 is connected to an armature 52 which is moveable under the influence of a magnetic field generated, in use, by an actuator 54 including windings 56. A spring 58 is arranged to bias the valve member 48 into engagement with the seating 50. As illustrated in FIG. 1, the actuator 54 and spring 58 are located within a nozzle holder 60, a cap nut 62 being in screw-threaded engagement with the nozzle holder 60 and securing the nozzle body 14, the spring housing 26 and the valve housing 44 to the nozzle holder 60.

As illustrated most clearly in FIG. 2, the control chamber 38 communicates through passages 64 with an annular chamber defined between a region of the valve member 48 of reduced diameter and the bore 46 within which the valve member 48 is slidable. When the valve member 48 engages its seating 50, the valve member 48 is substantially fuel pressure balanced, and the spring 58 is of sufficient strength to cause the valve member 48 to remain in this position. Energization of the actuator 54 results in movement of the valve member 48 away from the seating 50 against the action of the spring 58 resulting in fuel being permitted to flow from the control chamber 38 to a chamber 66 within which the armature 52 is located, the chamber 66 communicating through a passage (not shown) with a low pressure drain or reservoir. The chamber 66 further communicates through passage 68, 70 with a chamber within which the lower end of the valve member 48 is located and with the spring chamber.

In use, with the actuator 54 de-energized and with the supply passage 22 supplied with fuel under high pressure from an appropriate source, for example a common rail charged with fuel under high pressure by an appropriate pump, it will be appreciated that the thrust surface 24 and the exposed part of the frusto-conical surface 16 are supplied with fuel under pressure, and thus a force is applied to the valve needle 10 urging the needle 10 away from its seating. This force is opposed by the action of the spring 32 and by the action of fuel under pressure within the control chamber 38 upon the exposed end surface of the piston 36. The effective area of the piston 36 exposed to the fuel pressure within the control chamber 38 is greater than the effective areas of the thrust surface 24 and the exposed part of the frusto-conical surface 16, and as substantially the same pressure is applied to all of these parts of the injector, it will be appreciated that the force applied to the needle 10 is a downward force, urging the valve needle 10 to remain in engagement with the seating 18. It will be appreciated, therefore, that injection is not occurring.

In order to commence injection, the actuator 54 is engerized resulting in upward movement of the valve member 48 against the action of the spring 58. Such movement of the valve member 48 permits fuel to escape from the control chamber 38 thus reducing the fuel pressure applied to the piston 36. It will be appreciated that the presence of the restricted passage 40 restricts the rate at which fuel flows to the control chamber 38 from the supply passage 22, thus the movement of the valve member 48 away from the seating 50 results in a reduction in the fuel pressure within the control chamber 38. The reduction in fuel pressure applied to the piston 36 reduces the downward force applied to the valve needle 10, and a point will be reached beyond which the valve needle 10 is able to move against the action of the spring 32 and against the fuel pressure applied to the piston 36, moving the valve needle 10 away from its seating 18, and thus permitting fuel to flow to the outlet openings, and through the openings to the cylinder of the associated engine within which the injector is mounted.

As illustrated in FIG. 2, the volume of the control chamber 38 is relatively small, and as upward movement of the valve needle 10 occurs, the piston member 36 may move into engagement with the blind end of the bore 28 thus acting to limit upward movement of the valve needle 10. In order to maximise the area of the piston member 36 exposed to the fuel pressure in the control chamber 38 under these circumstances, the upper end face of the piston member 36 is conveniently of frusto-conical shape, thus only the central region of the piston member 36 is permitted to move into engagement with the spring housing 26.

It will be appreciated that a small quantity of fuel flows from the supply passage 22 through the restricted passage 40 to the control chamber 38 during injection. The dimensions of the restricted passage 40 are chosen to ensure that the quantity of fuel under pressure which is able to escape in this manner is minimised.

In order to terminate injection, the actuator 54 is de-energized and the valve member 48 returns into engagement with the seating 50 under the action of the spring 58. Such movement of the valve member 48 prevents further fuel from escaping from the control chamber 38 to the low pressure drain, and the continued supply of fuel through the restricted passage 40 to the control chamber 38 results in the fuel pressure within the control chamber 38 increasing. Clearly, therefore, the fuel pressure applied to the piston member 36 and hence the force transmitted through the thrust pin 42 to the valve needle 10 is increased, and a point will be reached beyond which the action of the fuel pressure within the control chamber 38 in combination with the action of the spring 32 is sufficient to cause the valve needle 10 to move into engagement with the seating 18, thus terminating the supply of fuel to the outlet openings and terminating injection. As the effective area of the piston 36 is greater than that of the thrust surfaces of the needle, termination of injection occurs rapidly.

It will be appreciated that as the thrust pin 42 is of relatively short axial length, even though the thrust pin 42 is of small diameter, for example 2 mm, flexing or compression of the thrust pin 42 to a significant extent does not occur. As a result, when the fuel pressure within the control chamber 38 reduces when injection is to commence, the initial movement of the piston 36 does not simply result in extension of the thrust pin 42 but rather the valve needle 10 commences movement immediately. Jerky movement of the injector needle is therefore reduced or avoided, and injection is more controlled. Although in the description hereinbefore the thrust pin 42 is described as being a separate component, it will be appreciated that the thrust pin may form an extension of the valve needle or the piston, if desired.

We claim:

1. A fuel injector having a fuel outlet comprising:

a valve needle, moveable within a first bore and engageable with a seating to control fuel flow through the outlet, the valve needle having a thrust surface having a first effective surface area and oriented such that the application of fuel under pressure thereto applies a force to the valve needle urging the valve needle away from the seating, and wherein the valve needle includes an upper guide region including a first surface, at an end remote from the fuel outlet, which is arranged to cooperate with an adjacent region of the first bore so as to guide movement of the valve needle within the first bore;

a valve member for controlling fuel pressure within a control chamber;

a housing defining a second bore comprising a first bore portion and a second bore portion, the first bore portion having a first diameter and the second bore portion having a second diameter which is greater than the first diameter of the first bore portion;

a piston member consisting of no more than one cylinder including a substantially constant diameter and a frusto-conical end and being slidable within the first bore portion and the second bore portion and configured to at least partially define the control chamber within the second bore portion, the piston member being exposed to fuel pressure within the control chamber and being arranged to transmit a force applied by the fuel pressure to the valve needle, wherein the piston member has a second effective surface area exposed to the fuel pressure which is greater than the first effective surface area of the thrust surface so as to urge the valve needle towards the seating; and a thrust pin member engaged between the piston member and the valve needle, such that the thrust pin member is in engagement with a second surface of the upper guide region of the valve needle, the thrust pin member being configured to transmit the force applied to the piston member by the fuel pressure to the valve needle, wherein the thrust pin member has an axial length which is sufficiently short to ensure flexing of the thrust pin member is limited following reduction in fuel pressure within the control chamber.

2. The injector as claimed in claim 1, wherein the thrust pin member is a separate and distinct component from the piston member.

3. The injector of claim 1, wherein the thrust pin member forms an integral extension of the valve needle.

4. The injector of claim 1, wherein the piston member has a surface which defines the second effective surface area to which fuel pressure is applied, wherein the piston member is of frusto-conical form.

5. The injector of claim 1 comprising a spring, located between the piston member and the valve needle, the spring acting to bias the valve needle towards the seating.

6. The injector of claim 5, wherein the second bore is of stepped form, the spring having an associated abutment member engaging a step forming part of the second bore.

7. The injector as claimed in claim 5, wherein the spring is engaged between a spring abutment member and the valve needle.

8. The injector of claim 1, the control chamber communicating with a supply passage of fuel by means of a second passage being arranged to restrict the rate of fuel flow to the control chamber from the supply passage to ensure movement of the valve member away from the seating results in the reduction in fuel pressure within the control chamber.

9. The injector of claim 1 wherein the first and the second bore portions are circular and the internal dimensions individually comprise a diameter of the respective bore portion.

10. The injector of claim 9 wherein the first and the second bore portions comprise a stepped bore configuration.

11. The injector of claim 9 wherein the piston member contacts the first bore portion and is radially spaced from the second bore portion.

12. The injector of claim 1 wherein the first and the second bore portions comprise a stepped bore configuration.

13. The injector of claim 1 wherein the piston member contacts the first bore portion and is radially spaced from the second bore portion.

14. The injector of claim 1 wherein the upper region of the valve needle contacts a surface of the first bore.

15. A fuel injector having a fuel outlet comprising:

a nozzle body;

a valve needle, engageable with a seating to control fuel flow through the outlet, the valve needle having a thrust surface having a first effective surface area and oriented such that the application of fuel under pressure thereto applies a force to the valve needle urging the valve needle away from the seating;

a valve member for controlling fuel pressure within a control chamber;

a piston member consisting of no more than one cylinder including a substantially constant diameter and a frusto-conical end and being slidable within a bore and defining, with the bore, the control chamber, the piston member being exposed to fuel pressure within the control chamber and being arranged to transmit a force applied by the fuel pressure to the valve needle, wherein the piston member has a second effective surface area exposed to the fuel pressure which is greater than the first effective surface area of the thrust surface so as to urge the valve needle towards the seating; and a thrust pin member engaged between the piston member and the valve needle and which is configured to transmit the force applied to the piston member by the fuel pressure to the valve needle, wherein an end portion of the valve needle has a first surface engaged with the thrust pin member and a second surface configured to contact the nozzle body forming a guide region configured to guide movement of the valve needle.

16. The injector of claim 15 wherein the thrust pin member has an axial length which is sufficiently short to ensure flexing of the thrust pin member is limited following reduction in fuel pressure within the control chamber.

17. The injector of claim 15 further comprising a housing defining the bore comprising a first bore portion and a second bore portion, the first bore portion having a first diameter and the second bore portion having a second diameter which is greater than the first diameter of the first bore portion, and wherein the piston member is slidable within the first bore portion and the second bore portion and configured to at least partially define the control chamber within the second bore portion.

18. The injector of claim 15 wherein the thrust pin member forms an integral extension of the valve needle.

19. The injector of claim 15 wherein the piston member has a surface which defines the second effective surface area to which fuel pressure is applied, wherein the piston member is of frusto-conical form.

20. The injector of claim 15 further comprising a spring located between the piston member and the valve needle, the spring acting to bias the valve needle towards the seating.

21. The injector of claim 20 wherein the bore is of stepped form, the spring having an associated abutment member engaging a step forming part of the bore.

22. The injector of claim 15 wherein the control chamber communicates with a supply passage of fuel by means of a second passage being arranged to restrict the rate of fuel flow to the control chamber from the supply passage to ensure movement of the valve member away from the seating results in the reduction in fuel pressure within the control chamber.

23. The injector as claimed in claim 15, wherein the thrust pin member is a separate and distinct component from the piston member.

* * * * *